US005180515A

United States Patent [19]

Boucher et al.

[11] Patent Number: 5,180,515

[45] Date of Patent: Jan. 19, 1993

[54] GRANULAR DETERGENT COMPOSITIONS HAVING LOW LEVELS OF POTASSIUM SALT TO PROVIDE IMPROVED SOLUBILITY

[75] Inventors: Jeffrey E. Boucher, Cincinnati; Eugene J. Pancheri, Montgomery, both of Ohio

[73] Assignee: The Procter & Gamble Company, Cincinnati, Ohio

[21] Appl. No.: 656,117

[22] Filed: Feb. 14, 1991

Related U.S. Application Data

[63] Continuation of Ser. No. 385,848, Jul. 27, 1989, abandoned.

[51] Int. Cl.[5] ..... C11D 3/04; C11D 17/06; C11D 3/065

[52] U.S. Cl. ..... 252/135; 252/531; 252/534; 252/539; 252/550; 252/553; 252/558; 252/174.13; 252/174.14

[58] Field of Search ..... 252D/135, 531, 534, 252D/550, 553, 539, 558, 174.14, 174.13

[56] References Cited

U.S. PATENT DOCUMENTS

| | | | |
|---|---|---|---|
| 2,381,960 | 8/1945 | Johnson | 210/697 |
| 2,992,186 | 7/1961 | Hellsten | 252/135 |
| 3,620,979 | 11/1971 | Corliss et al. | 252/385 |
| 3,849,327 | 11/1974 | DiSalvo et al. | 252/109 |
| 3,957,695 | 5/1976 | Davies et al. | 252/532 |
| 3,989,635 | 11/1976 | Toyoda | 252/135 |
| 4,019,998 | 4/1977 | Benson et al. | 252/135 |
| 4,101,455 | 7/1978 | Francis et al. | 252/531 |
| 4,116,852 | 9/1978 | Bailey et al. | 252/135 |
| 4,131,558 | 12/1978 | Bailey | 252/135 |
| 4,299,717 | 11/1981 | Cottrell et al. | 252/99 |
| 4,308,158 | 12/1981 | Gohla et al. | 252/97 |
| 4,379,080 | 4/1983 | Murphy | 252/526 |
| 4,487,710 | 12/1984 | Kaminsky | 252/531 |
| 4,657,693 | 4/1987 | Wise et al. | 252/174.21 |
| 4,715,979 | 12/1987 | Moore | 252/531 |

FOREIGN PATENT DOCUMENTS

| | | |
|---|---|---|
| 0229671 | 1/1986 | European Pat. Off. . |
| 229671 | 7/1987 | European Pat. Off. . |
| 61-164000 | 7/1986 | Japan . |
| 607274 | 12/1940 | United Kingdom . |
| 1460893 | 1/1977 | United Kingdom . |
| 1551239 | 8/1979 | United Kingdom . |

OTHER PUBLICATIONS

Chemical Principles, 4th ed., Masterton Slowinki, W. B. Saunders Co. 1977, p. 435.

*Primary Examiner*—Paul Lieberman
*Assistant Examiner*—Bradley A. Swope
*Attorney, Agent, or Firm*—Kathleen M. Harleston; Donald E. Hasse; Ronald L. Hemingway

[57] ABSTRACT

Granular detergent compositions including low levels of potassium salts, sodium phosphate, and sodium carbonate are disclosed for improved solubility. Also disclosed are processes for improving solubility of granular detergent compositions.

17 Claims, No Drawings

GRANULAR DETERGENT COMPOSITIONS HAVING LOW LEVELS OF POTASSIUM SALT TO PROVIDE IMPROVED SOLUBILITY

This is a continuation of application Ser. No. 385,848, filed on Jul. 27, 1989 now abandoned.

FIELD OF THE INVENTION

The present invention relates to granular detergent compositions having improved solubility. More particularly, it relates to granular detergent laundry compositions and additives containing sodium carbonate and sodium phosphate and low levels of potassium salt for improved cold water solubility. Processes for improving solubility of granular detergent compositions are also included.

BACKGROUND OF THE INVENTION

This invention was made during a search for a way to improve solubility of granular laundry detergent products and prevent clumps of detergent from remaining in the washer and on washed clothes. Such clumps, which may appear as solid white masses ranging from about 5 to 40 millimeters in diameter and about 2 to 10 millimeters in length, have occurred during cold water washes when the order of addition to the washing machine is laundry detergent product first, clothes second, and water last. It has been found that the primary contributors to this solubility problem are the sodium carbonate and sodium phosphate in the granular laundry detergent. It has been discovered that surprisingly low levels of potassium salts can be included in the granular detergent composition to improve solubility and eliminate or reduce this clumping problem.

Sodium carbonate and sodium pyrophosphate have been used in granular detergent compositions (for example, U.S. Pat. No. 4,299,717, Cottrell et al, issued Nov. 10, 1981). Potassium salt has been substituted for sodium salt to eliminate giant micelles of sodium salt of washed fatty acid in the washing liquid (Japanese Patent Application 61164000). The solubility of a solid is lower in a solution of a salt containing a common ion than in pure water (*Chemical Principles,* 4th ed., Masterton Slowinski, W. B. Saunders Co. 1977, pg. 435). Lastly, a water-softening composition comprising tetrasodium pyrophosphate and an alkaline material selected from the group consisting of trisodium phosphate, sodium hydroxide, sodium carbonates, potassium hydroxide, potassium carbonates, soap and sodium silicate is disclosed in U.S. Pat. No. 2,381,960, Johnson, patented Aug. 14, 1945. However, it has not been disclosed that low levels of potassium salt can be added to a granular laundry detergent composition or additive containing sodium carbonate and sodium phosphate to improve solubility of the composition in water.

SUMMARY OF THE INVENTION

The instant invention presents a granular laundry detergent composition comprising:

(a) from about 5 to 70 weight % detergent surfactant selected from the group consisting of anionics, nonionics, zwitterionics, ampholytics, cationics, and mixtures thereof;
(b) from about 5 to 70 weight % sodium phosphate;
(c) from about 5 to 70 weight % sodium carbonate; and
(d) from about 0.1 to 10 weight % potassium salt.

A process for improving solubility of a granular laundry detergent composition according to the above is also presented.

DESCRIPTION OF THE INVENTION

This invention covers a granular laundry detergent composition or additive which is soluble in cold or cool water, i.e. the composition or additive readily dissolves/disperses in water at a temperature between about 32° F. (0° C.) and 90° F. (32.2° C.), preferably between about 35° F. (1.6° C.) and 50° F. (10° C.). Because of the incorporation of a surprisingly low level of potassium salt in the product, no significant amount of product remains bound in the clothes or in the bottom of the washing machine tub after a typical cold water wash cycle, even with a product first, clothes second, water last order of addition. A process for improving solubility or dispersibility of a granular detergent composition is also included in the invention.

The claimed granular laundry detergent composition or additive comprises:

(a) from about 5 to 70 weight % detergent surfactant selected from the group consisting of anionics, nonionics, zwitterionics, ampholytics, cationics, and mixtures thereof;
(b) from about 5 to 70 weight % sodium phosphate;
(c) from about 5 to 70 weight % sodium carbonate; and
(d) from about 0.1 to 10 weight % potassium salt.

A. Detergent Surfactant

The first ingredient, present at a level of from about 5 to 70 weight %, preferably about 10 to 30 weight %, is detergent surfactant selected from the group consisting of anionics, nonionics, zwitterionics, ampholytics, cationics, and mixtures thereof. Preferred is from about 10 to 30 weight %, most preferably from about 12 to 20 weight %, detergent surfactant selected from the group consisting of anionics, nonionics, cationics, and mixtures thereof.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14, abbreviated as $C_{11-14}$ LAS.

Especially preferred is from about 12 to 20 weight % of a mixture of $C_{10-16}$ linear alkylbenzene sulfonate and $C_{12-18}$ alkyl sulfate. These are preferably in a weight ratio of between 50:50 and 80:20, preferably 70:30, sodium $C_{10-16}$ (preferably $C_{11-14}$) LAS:sodium $C_{12-18}$ (preferably $C_{14-16}$) alkyl sulfate.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the instant detergent granules. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol.

Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Semi-polar nonionic surfactants include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80.

Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent granules. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, which is incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

B. Sodium Phosphate

The second required ingredient, present in the instant granular detergent composition at a level of from about 5 to 70 weight %, preferably from about 10 to 40 weight %, most preferably about 15 to 35 weight %, is sodium phosphate.

Sodium phosphates for use herein may be sodium orthophosphate ($Na_3PO_4$ sodium pyrophosphate ($Na_4P_2O_7$), sodium tripolyphosphate ($Na_5P_3O_{10}$), and/or sodium metaphosphate ($NaPO_3$) and amorphous phosphate glasses. Tripolyphosphate generally has better detergency than pyrophosphate, which is better than orthophosphate. Metaphosphate and many of the phosphate glasses (supercooled solutions) are equal to or better than tripolyphosphate in detergency, but they are undesirable in that they can be unstable at normal crutcher pH and they may form sticky product.

Sodium tripolyphosphate is an especially good builder and, along with sodium pyrophosphate, is preferred for use herein. Sodium tripolyphosphate is formed by condensing together three orthophosphate molecules with elimination of water, yielding a straight chain molecule. It may be anhydrous or hydrated. Some hydrolysis (reversion) occurs during processing of the sodium tripolyphosphate (STPP). Therefore the actual builder ratio (versus formulated ratio) may consist of a higher ratio of STPP to pyrophosphate.

The instant granular detergent composition preferably comprises from about 1 to 10 weight % sodium tripolyphosphate (STPP). It is preferred that this granular laundry detergent composition have a phosphate builder system comprising:

(a) crutched phosphate builder selected from STPP and TSPP and mixtures thereof; wherein the crutched builder is in spray-dried detergent granules; and (b) admixed phosphate builder selected from STPP and TSPP and mixtures thereof; and wherein (a) and (b) have a ratio of from about 1:25 to about 25:1; the phosphate builder system having from 0 to about 50% of the admixed TSPP by weight of the phosphate builder system, according to pending U.S. patent application Ser. No. 231,108, Beerse et al, filed Aug. 11, 1988.

Most useful herein are sodium pyrophosphate salts, which can be obtained commercially or can be formed by neutralization of the corresponding pyrophosphoric acids or acid salts. Readily available commercially are tetrasodium pyrophosphate (TSPP) $Na_4P_2O_7$ and its decahydrate $Na_4P_2O_7.10H_2O$, sodium acid pyrophosphate or "acid pyro" $Na_2H_2P_2O_7$ and its hexahydrate $Na_2H_2P_2O_7.6H_2O$, and pyrophosphoric acid $H_4P_2O_7$. The generic formula for the anhydrous forms of these compounds can be expressed as $Na_xH_yP_2O_7$, where x and y are integers having the sum of 4.

The sodium pyrophosphate herein can be tetrasodium pyrophosphate (TSPP; preferred), trisodium pyrophosphate, disodium pyrophosphate, monosodium pyrophosphate, or mixtures thereof. These may be anhydrous (preferred) or hydrated.

C. Sodium Carbonate

The third required ingredient in the instant granular detergent composition is present at a level of from about 5 to 70 weight %, preferably from about 8 to 50 weight %, most preferably from about 11 to 30 weight %, and is sodium carbonate. Sodium carbonate ($Na_2CO_3$) can easily be obtained commercially.

D. Potassium Salts

The fourth required ingredient herein, which is present at a level of from about 0.1 to 10 weight %, preferably from about 0.5 to 5 weight %, most preferably from about 1 to 3 weight %, is potassium salt. When the potassium salt is sprayed on the sodium carbonate rather than being crutched or admixed in the granular detergent composition (see below), the preferred amount of potassium salt is from about 0.1 to 2 weight %, preferably from about 0.2 to 1 weight %.

Of the potassium salts, inorganic potassium salts are preferred, and are more preferably selected from the group consisting of potassium chloride (KCl), potassium carbonate ($K_2CO_3$), potassium sulfate ($K_2SO_4$), and mixtures thereof. These are commercially available. Potassium carbonate is most preferred.

Inorganic potassium salts may include dehydrated (preferably) or hydrated tetrapotassium pyrophosphate ($K_4P_2O_7$; preferred), tripotassium pyrophosphate ($HK_3P_2O_7$), dipotassium pyrophosphate ($H_2K_2P_2O_7$), and monopotassium pyrophosphate ($H_3KP_2O_7$). Of the hydrates, those which are stable up to about 120° F. (48.9° C.) are preferred.

Other potassium salts for use herein are dehydrated (preferably) or hydrated pentapotassium tripolyphosphate ($K_5P_3O_{10}$), tetrapotassium tripolyphosphate ($HK_4P_3O_{10}$), tripotassium tripolyphosphate ($H_2K_3P_3O_{10}$), dipotassium tripolyphosphate ($H_3K_2P_3O_{10}$), and monopotassium tripolyphosphate ($H_4KP_3O_{10}$); potassium hydroxide (KOH); potassium silicate; and potassium neutralized surfactant such as linear potassium alkylbenzene sulfonate, potassium alkyl sulfate, and/or potassium alkylpolyethoxylate.

Also suitable for use herein are salts of film forming polymers as described in U.S. Pat. No. 4,379,080, Murphy, issued Apr. 5, 1983, column 8, line 44 to column 10, line 37, incorporated herein, which are either partially or wholly neutralized with potassium. Particularly preferred are the potassium salts of copolymers of acrylamide and acrylate having a molecular weight between about 4,000 and 20,000.

It is preferred that the potassium salts herein have a mean particle size of less than about 200 microns, more preferably between about 1 and 100 microns, most preferably between about 1 and 10 microns.

E. Other Ingredients

Additional detergent ingredients suitable for inclusion in a granular detergent composition may be added to the instant composition. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

F. Process

Also included in the instant invention is a process for improving solubility or dispersibility of a granular detergent composition as described above. The process comprises:

(a) producing detergent granules comprising detergent surfactant selected from the group consisting of anionics, nonionics, zwitterionics, ampholytics, cationics, and mixtures thereof; and sodium phosphate; and (b) admixing with said detergent granules sodium carbonate and potassium salt;

wherein the final detergent composition comprises from about 5 to 70 weight % of the detergent surfactant, from about 5 to 70 weight % sodium phosphate, from about 5 to 70 weight % sodium carbonate, and from about 0.1 to 10 weight % of the potassium salt.

Preferably, this process comprises:

(a) forming a paste comprising sodium linear $C_{10-16}$ alkylbenzene sulfonate and sodium $C_{12-18}$ alkyl sulfate in a ratio between 50:50 and 80:20;

(b) crutching the paste with sodium pyrophosphate;

(c) spray drying the mixture of step (b) to form detergent granules; and (d) admixing the detergent granules with sodium carbonate and inorganic potassium salt selected from the group consisting of potassium chloride, potassium carbonate, potassium sulfate, and mixtures thereof, and having a mean particle size of less than about 200 microns;

wherein the final detergent composition comprises from about 12 to 20 weight % sodium linear $C_{10-16}$ alkylbenzene sulfonate and sodium $C_{12-18}$ alkyl sulfate, from about 15 to 30 weight % sodium pyrophosphate, from about 15 to 30 weight % sodium carbonate, and from about 0.5 to 5 weight % of the inorganic potassium salt.

It is preferred that step (b) above additionally comprise crutching the paste with sodium tripolyphosphate so that the final detergent composition comprises from about 1 to 10 weight % sodium tripolyphosphate.

Although the potassium salt and sodium carbonate are preferably admixed, step (d), in any order, they may be added in the crutcher, step (b).

Bleach and bleach activator and/or $C_{12-13}$ alkylpolyethoxylate are preferably also admixed in step (d). Polyethylene glycol, preferably of a molecular weight between about 6,000 and 12,000, sodium silicate, sodium sulfate and/or brightener are preferably added in the crutcher, step (b).

Instead of admixing or directly crutching the potassium salt, an aqueous solution of the potassium salt is distributed on the sodium carbonate in a preliminary step before admixing (preferred) or crutching the coated sodium carbonate. The potassium salt may (less preferably) be agglomerated with the sodium carbonate in, for example, a Schugi agglomerator using an aqueous solution of the potassium salt at levels sufficient to cause agglomeration. The distribution of the potassium salt may be by coating or, preferably, by spraying an aqueous solution on the surface of the sodium carbonate. Spraying on may be done in a Schugi agglomerator with the blades down and minimal residence time so the sodium carbonate is coated but not agglomerated. A rotating spray drum may alternatively be used to spray an aqueous solution of the potassium salt onto the sodium carbonate.

If the potassium salt (preferably inorganic salt, most preferably potassium carbonate, potassium chloride or potassium sulfate), is sprayed on, the percentage of it in the finished product can be lower than if it is admixed (or directly crutched), without losing effectiveness. From about 0.1 to 10 weight %, preferably from about 0.1 to 2 weight %, most preferably from about 0.2 to 1 weight % potassium salt may be sprayed on the sodium carbonate. The potassium salt can be mixed in water, at a concentration at less than saturation for a given temperature, for subsequent distribution over the surfaces of the sodium carbonate particles. The coated sodium carbonate is then incorporated into the granular detergent composition.

Certain ratios of sodium carbonate, sodium pyrophosphate and/or potassium salt are preferred, as follows, when the potassium salt is admixed:

| | Preferred | More Preferred | Most Preferred |
|---|---|---|---|
| Potassium salt: sodium pyrophosphate | 2:1 to 1:140 | 1:2 to 1:40 | 1:5 to 1:20 |
| Potassium salt: sodium carbonate | 2:1 to 1:140 | 1:2 to 1:50 | 1:5 to 1:30 |
| Sodium pyrophosphate: sodium carbonate | 15:1 to 1:15 | 5:1 to 1:6 | 1:1 to 1:2 |

Certain ratios of the above are preferred when the potassium salt is sprayed on the sodium carbonate:

| | Preferred | More Preferred | Most Preferred |
|---|---|---|---|
| Potassium salt: sodium pyrophosphate | 3:1 to 1:280 | 1:2 to 1:80 | 1:5 to 1:20 |
| Potassium salt: sodium carbonate | 3:1 to 1:280 | 1:2 to 1:110 | 1:5 to 1:25 |
| Sodium pyrophosphate: sodium carbonate | 14:1 to 1:14 | 5:1 to 1:6 | 1:1 to 2:1 |

The following examples illustrate the compositions and processes of the present invention. All parts, percentages, and ratios herein are by weight unless otherwise specified.

EXAMPLE I

A granular laundry detergent composition of the present invention is as follows:

| Component | Active Weight % |
|---|---|
| Sodium $C_{12.3}$ linear alkylbenzene sulfonate | 8.66 |
| Sodium $C_{14-15}$ alkyl sulfate | 4.14 |
| Sodium tripolyphosphate | 2.09 |
| Tetrasodium pyrophosphate | 17.44 |
| Sodium silicate | 7.04 |
| Pentasodium diethylenetriamine pentaacetate | 0.30 |
| Polyethylene glycol | 0.25 |
| Sodium polyacrylate | 0.88 |
| Brightener | 0.11 |
| Moisture | 4.61 |
| Sodium perborate monohydrate | 4.32 |
| Nonanoyloxybenzene sulfonate | 5.04 |
| Sodium carbonate | 20.72 |
| Potassium carbonate | 4.80 |
| Sodium sulfate/Miscellaneous | 19.60 |

The process used to make this composition is as follows:

| Stock Material | Weight % |
|---|---|
| Step 1 | |
| Sodium $C_{12.3}$ linear alkylbenzene | 6.51 |
| Sulfuric acid | 5.47 |
| Sodium $C_{14-15}$ fatty alcohol | 2.77 |

-continued

| Stock Material | Weight % |
|---|---|
| Sulfuric acid | 2.57 |
| Sodium hydroxide | 4.39 |
| Water | 17.18 |
| Sodium polyacrylate | 2.14 |
| Step 2 | |
| Polyethylene glycol | 0.58 |
| Tetrasodium pyrophosphate | 17.16 |
| Sodium tripolyphosphate | 4.54 |
| Sodium silicate | 16.01 |
| Sodium sulfate | 12.51 |
| Brightener | 0.17 |
| Pentasodium diethylenetriamine pentaacetate | 1.05 |
| Step 3 | |
| Sodium perborate monohydrate | 4.32 |
| Nonanoyloxybenzene sulfonate | 6.47 |
| Sodium carbonate | 20.72 |
| Potassium carbonate | 4.80 |

The ingredients listed in step 1 are added together to form a paste. This paste is then crutched with the ingredients listed in step 2. This mixture is then spray dried to evaporate the excess moisture and form detergent granules. The ingredients listed in step 3 are then admixed to form the finished granular detergent composition.

The composition ("product") is evaluated in a washing machine test designed to simulate consumer wash conditions that promote insoluble clump formation (cold water, product/clothes/water order of addition, normal cycle, large load). Visually, the insoluble clumps appear as solid, white masses, about 5 to 40 millimeters in diameter and about 2 to 10 millimeters in length, which remain bound in the washed clothes or can be seen at the bottom of the washing machine tub after the clothes are removed. In this test, the composition containing potassium carbonate has little to no product remaining while the same composition without potassium carbonate has a significant amount of product remaining as insoluble clumps. Consumer complaint information suggests that insoluble clumps remaining after washing are unacceptable.

| | % Product Remaining* (at the end of wash/rinse) Standard | Standard Deviation |
|---|---|---|
| Product without potassium carbonate | 7.5% | 1.4 |
| Product with potassium carbonate | 0.7% | 0.6 |

*These numbers represent the average across 3 replicates.

EXAMPLE II

A granular laundry detergent composition of the present invention is as follows:

| Component | Active Weight % |
|---|---|
| Sodium $C_{12-3}$ linear alkylbenzene sulfonate | 8.92 |
| Sodium $C_{14-15}$ alkyl sulfate | 4.26 |
| Sodium tripolyphosphate | 2.15 |
| Tetrasodium pyrophosphate | 17.96 |
| Sodium silicate | 7.25 |
| Pentasodium diethylenetriamine pentaacetate | 0.31 |
| Polyethylene glycol | 0.26 |
| Sodium polyacrylate | 0.91 |
| Brightener | 0.12 |
| Moisture | 4.74 |
| Sodium perborate monohydrate | 4.44 |
| Nonanoyloxybenzene sulfonate | 5.19 |
| Sodium carbonate | 21.34 |
| Sodium sulfate/Miscellaneous | 20.20 |

-continued

| Component | Active Weight % |
|---|---|
| Potassium chloride | 1.98 |

The process used to make this composition is as follows:

| Stock Material | Weight % |
|---|---|
| Step 1 | |
| Sodium $C_{12-3}$ linear alkylbenzene | 6.51 |
| Sulfuric acid | 5.47 |
| Sodium $C_{14-15}$ fatty alcohol | 2.77 |
| Sulfuric acid | 2.57 |
| Sodium hydroxide | 4.39 |
| Water | 17.18 |
| Sodium polyacrylate | 2.14 |
| Step 2 | |
| Polyethylene glycol | 0.58 |
| Tetrasodium pyrophosphate | 17.16 |
| Sodium tripolyphosphate | 4.54 |
| Sodium silicate | 16.01 |
| Sodium sulfate | 12.51 |
| Brightener | 0.17 |
| Pentasodium diethylenetriamine pentaacetate | 1.05 |
| Step 3 | |
| Sodium perborate monohydrate | 4.32 |
| Nonanoyloxybenzene sulfonate | 6.47 |
| Sodium carbonate | 21.34 |
| Potassium chloride* | 1.98 |

*Micronized to mean particle size of 1.5 microns.

The ingredients listed in step 1 are added together to form a paste. This paste is then crutched with the ingredients listed in step 2. This mixture is then spray dried to evaporate the excess moisture and form detergent granules. The ingredients listed in step 3 are then admixed to form the finished granular detergent composition.

The composition ("product") is evaluated in a washing machine test designed to simulate consumer wash conditions that promote insoluble clump formation (cold water, product/clothes/water order of addition, normal cycle, large load). Visually, the insoluble clumps appear as solid, white masses which remain bound in the washed clothes or can be seen at the bottom of the washing machine tub after the clothes are removed. In this test, the composition containing potassium chloride has significantly fewer insoluble clumps than the same composition with no potassium chloride.

| | % Product Remaining* (at the end of wash/rinse) | Standard Deviation |
|---|---|---|
| Product without potassium chloride | 7.5% | 1.4 |
| Product with potassium chloride | 1.0% | 1.7 |

*These numbers represent the average across 3 replicates.

EXAMPLE III

A granular laundry detergent composition of the present invention is as follows:

| Component | Active Weight % |
|---|---|
| Sodium $C_{12-3}$ linear alkylbenzene sulfonate | 8.92 |
| Sodium $C_{14-15}$ alkyl sulfate | 4.26 |
| Sodium tripolyphosphate | 2.15 |
| Tetrasodium pyrophosphate | 17.96 |
| Sodium silicate | 7.25 |

-continued

| Component | Active Weight % |
|---|---|
| Pentasodium diethylenetriamine pentaacetate | 0.31 |
| Polyethylene glycol | 0.26 |
| Sodium polyacrylate | 0.91 |
| Brightener | 0.12 |
| Water | 4.74 |
| Sodium perborate monohydrate | 4.44 |
| Nonanoyloxybenzene sulfonate | 5.19 |
| Sodium carbonate | 21.34 |
| Sodium sulfate/Miscellaneous | 20.20 |
| Potassium sulfate | 1.98 |

The process used to make this composition is as follows:

| Stock Material | Weight % |
|---|---|
| Step 1 | |
| Sodium $C_{12,3}$ linear alkylbenzene | 6.51 |
| Sulfuric acid | 5.47 |
| Sodium $C_{14-15}$ fatty alcohol | 2.77 |
| Sulfuric acid | 2.57 |
| Sodium hydroxide | 4.39 |
| Water | 17.18 |
| Sodium polyacrylate | 2.14 |
| Step 2 | |
| Polyethylene glycol | 0.58 |
| Tetrasodium pyrophosphate | 17.16 |
| Sodium tripolyphosphate | 4.54 |
| Sodium silicate | 16.01 |
| Sodium sulfate | 12.51 |
| Brightener | 0.17 |
| Pentasodium diethylenetriamine pentaacetate | 1.05 |
| Step 3 | |
| Sodium perborate monohydrate | 4.32 |
| Nonanoyloxybenzene sulfonate | 6.47 |
| Sodium carbonate | 21.34 |
| Potassium sulfate* | 1.98 |

*Micronized to mean particle size of 1.5 microns.

The ingredients listed in step 1 are added together to form a paste. This paste is then crutched with the ingredients listed in step 2. This mixture is then spray dried to evaporate the excess moisture and form detergent granules. The ingredients listed in step 3 are then admixed to form the finished granular detergent composition.

The composition ("product") is evaluated in a washing machine test designed to simulate consumer wash conditions that promote insoluble clump formation (cold water, product/clothes/water order of addition, normal cycle, large load). Visually, the insoluble clumps appear as solid, white masses which remain bound in the washed clothes or can be seen at the bottom of the washing machine tub after the clothes are removed. In this test, the composition containing potassium sulfate had little to no product remaining while the same composition with no potassium sulfate had a significant amount of product remaining as insoluble clumps.

| | % Product Remaining* (at the end of wash/rinse) | Standard Deviation |
|---|---|---|
| Product without potassium sulfate | 7.5% | 1.4 |
| Product with potassium sulfate | 1.0% | 0 |

*These numbers represent the average across 3 replicates.

EXAMPLE IV

A granular laundry detergent composition of the present invention is as follows:

| Component | Active Weight % |
|---|---|
| Sodium $C_{12,3}$ linear alkylbenzene sulfonate | 9.10 |
| Sodium $C_{14-15}$ alkyl sulfate | 4.35 |
| Sodium tripolyphosphate | 2.19 |
| Tetrasodium pyrophosphate | 18.32 |
| Sodium silicate | 7.39 |
| Pentasodium diethylenetriamine pentaacetate | 0.31 |
| Polyethylene glycol | 0.27 |
| Sodium polyacrylate | 0.92 |
| Brightener | 0.12 |
| Water | 4.84 |
| Sodium perborate monohydrate | 4.53 |
| Nonanoyloxybenzene sulfonate | 5.29 |
| Potassium sulfate coated sodium carbonate | 21.77 |
| Sodium sulfate/Miscellaneous | 20.59 |

The process used to make this composition is as follows:

| Stock Material | Weight % |
|---|---|
| Step 1 | |
| Sodium $C_{12,3}$ linear alkylbenzene | 6.51 |
| Sulfuric acid | 5.47 |
| Sodium $C_{14-15}$ fatty alcohol | 2.77 |
| Sulfuric acid | 2.57 |
| Sodium hydroxide | 4.39 |
| Water | 17.18 |
| Sodium polyacrylate | 2.14 |
| Step 2 | |
| Polyethylene glycol | 0.58 |
| Tetrasodium pyrophosphate | 17.16 |
| Sodium tripolyphosphate | 4.54 |
| Sodium silicate | 16.01 |
| Sodium sulfate | 12.51 |
| Brightener | 0.17 |
| Pentasodium diethylenetriamine pentaacetate | 1.05 |
| Step 3 | |
| Potassium sulfate* | 0.41 |
| Water | 1.22 |
| Sodium carbonate | 20.14 |
| Step 4 | |
| Sodium perborate monohydrate | 4.32 |
| Nonanoyloxybenzene sulfonate | 6.47 |

*Micronized to mean particle size of 1.5 microns.

The ingredients listed in step 1 are added together to form a paste. This paste is then crutched with the ingredients listed in step 2. This mixture is then spray dried to evaporate the excess moisture and form detergent granules. The first two ingredients listed in step 3 are then mixed together and sprayed onto the sodium carbonate. This sodium carbonate along with the ingredients listed in step 4 are then admixed to form the finished product.

The product is evaluated in a washing machine test designed to simulate consumer wash conditions that promote insoluble clump formation (cold water, product/clothes/water order of addition, normal cycle, large load). Visually, the clumps are white solid masses which can be found bound up in the clothes or in the bottom of the washer after the clothes are removed. In this test, the product with potassium sulfate coated sodium carbonate showed little to no product remaining while the same product with uncoated sodium carbonate had a significant amount of product remaining as insoluble clumps.

| | % Product Remaining* (at the end of wash/rinse) | Standard Deviation |
|---|---|---|
| Product without potassium sulfate | 7.5% | 1.4 |
| Product with potassium sulfate | 0.7% | 1.2 |

*These numbers represent the average across 3 replicates.

EXAMPLE V

A granular laundry detergent composition is as follows:

| Component | Active Weight % |
|---|---|
| Sodium $C_{12.3}$ linear alkylbenzene sulfonate | 12.01 |
| Sodium $C_{14-15}$ alkyl sulfate | 5.59 |
| Sodium tripolyphosphate | 33.73 |
| Tetrasodium pyrophosphate | 7.70 |
| Sodium silicate | 8.00 |
| Sodium carbonate | 9.17 |
| Potassium carbonate | 2.00 |
| Sodium perborate monohydrate | 0.40 |
| Sodium polyacrylate | 1.52 |
| Enzyme | 0.84 |
| Silicone | 0.16 |
| Brightener | 0.28 |
| Polyethylene glycol | 0.61 |
| $C_{12-13}$ alkylpolyethoxylate | 0.10 |
| Sodium sulfate | 8.95 |
| Perfume | 0.40 |
| Water | 7.34 |
| Miscellaneous | 1.20 |

The process used to make this composition is as follows:

Step 1

Sodium $C_{12.3}$ linear alkylbenzene, sodium $C_{14-15}$ fatty alcohol, sulfuric acid, sodium hydroxide, sodium polyacrylate, and water are added together to form a paste. This paste is then crutched with the ingredients in step 2.

Step 2

Polyethylene glycol, tetrasodium pyrophosphate, sodium tripolyphosphate, sodium silicate, sodium sulfate, and brightener are then crutched with the paste formed in step 1. This mixture is then spray dried to evaporate the excess moisture and form detergent granules.

Step 3

Sodium perborate monohydrate, sodium carbonate, potassium carbonate, silicone, $C_{12-13}$ alkylpolyethoxylate, and enzyme are admixed to form the finished product. Perfume is sprayed on.

The product is evaluated in a washing machine test designed to simulate consumer wash conditions that promote insoluble clump formation (cold water, product/clothes/water order of addition, normal cycle, large load). In this test, the product with potassium carbonate showed a significant reduction in insoluble clumps (% product remaining) compared to the same product without potassium carbonate.

| | % Product Remaining* (at the end of wash/rinse) | Standard Deviation |
|---|---|---|
| Product without potassium carbonate | 32.3% | 2.4 |
| Product with potassium carbonate | 3.5% | 3.5 |

Note:
The number associated with the no-potassium product is an average of 2 replicates.
The number associated with the potassium product is an average of 3 replicates.

EXAMPLE VI

A granular laundry detergent composition is as follows:

| Component | Active Weight % |
|---|---|
| Sodium $C_{12.3}$ linear alkylbenzene sulfonate | 9.49 |
| Sodium $C_{14-15}$ alkyl sulfate | 4.06 |
| Tetrasodium pyrophosphate | 8.67 |
| Crutched sodium tripolyphosphate | 16.07 |
| Admixed sodium tripolyphosphate | 5.86 |
| Sodium silicate | 8.18 |
| Sodium carbonate | 20.04 |
| Potassium carbonate | 2.00 |
| Sodium perborate monohydrate | 4.18 |
| Nonanoyloxybenzene sulfonate | 5.91 |
| Pentasodium diethylenetriamine pentaacetate | 0.49 |
| Enzyme | 0.63 |
| Sodium polyacrylate | 1.10 |
| Brightener | 0.19 |
| Polyethylene glycol | 0.34 |
| Sodium sulfate | 9.72 |
| $C_{12-13}$ alkylpolyethoxylate | 0.5 |
| Perfume | 0.25 |
| Water | 2.00 |
| Miscellaneous | 0.32 |

The process used to make this composition is as follows:

Step 1

Sodium $C_{12.3}$ linear alkylbenzene, sodium $C_{14-15}$ fatty alcohol, sulfuric acid, sodium hydroxide, sodium polyacrylate, and water are added together to form a paste. This paste is then crutched with the ingredients in step 2.

Step 2

Polyethylene glycol, tetrasodium pyrophosphate, crutched sodium tripolyphosphate, sodium silicate, sodium sulfate, brightener, and pentasodium diethylenetriamine pentaacetate are crutched with the paste formed in step 1. This mixture is then spray dried to evaporate the excess moisture and form detergent granules.

Step 3

Oxygen bleach, bleach activator, sodium carbonate, potassium carbonate, admixed sodium tripolyphosphate, and $C_{12-13}$ alkylpolyethoxylate, and enzyme are then admixed to form the finished product. Perfume is sprayed on.

The product is evaluated in a washing machine test designed to simulate consumer wash conditions that promote insoluble clump formation (cold water, product/clothes/water order of addition, normal cycle, large load). In this test, the product with potassium carbonate showed a significant reduction in insoluble clumps (% product remaining) compared to the same product without potassium carbonate.

| | % Product Remaining* (at the end of wash/rinse) | Standard Deviation |
|---|---|---|
| Product without potassium carbonate | 8.2% | 6.0 |
| Product with potassium carbonate | 1.9% | 3.4 |

Note:
These numbers represent the average across 3 replicates.

EXAMPLE VII

A granular laundry detergent of the present invention is as follows:

| Component | Active Weight % |
|---|---|
| Alkylpolyethoxylate | 7.52 |
| Sodium tripolyphosphate | 21.2 |
| Sodium carbonate | 51.90 |
| Sodium silicate | 4.95 |
| Oxygen bleach | 2.03 |
| Enzyme (Protease) | 0.85 |
| Brightener | 0.26 |
| Carboxymethyl cellulose | 0.29 |
| Perfume | 0.24 |
| Sodium sulfate/miscellaneous | 1.31 |
| Moisture | 4.48 |
| Potassium sulfate | 4.76 |

This composition is based on laboratory analysis of a representative sample of a competitive granular laundry detergent product. The product is evaluated in a washing machine test designed to simulate consumer wash conditions that promote insoluble clump formation (cold water, product/clothes/water order of addition normal cycle, large load). Visually, the clumps are white solid masses which can be found bound up in the clothes or in the bottom of the washer after the clothes are removed. In this test, the product with potassium sulfate showed a significant reduction in insoluble clumps compared to the same product without potassium sulfate.

| | % Product Remaining* (at the end of wash/rinse) | Standard Deviation |
|---|---|---|
| Product without potassium sulfate | 5.8 | 5.0 |
| Product with potassium sulfate | 0.7 | 1.2 |

*These numbers represent the average across 6 replicates.

What is claimed is:

1. A granular laundry detergent composition or additive, comprising:

(a) from about 5 to 70 weight % anionic detergent surfactant;

(b) from about 5 to 70 weight % sodium phosphate;

(c) from about 5 to 70 weight % sodium carbonate; and (d) from 1 to 5 weight % potassium salt.

2. A granular laundry detergent composition according to claim 1, comprising from about 10 to 30 weight % anionic surfactant.

3. A granular laundry detergent composition according to claim 2, comprising from about 12 to 20 weight % anionic detergent surfactant.

4. A granular laundry detergent composition according to claim 3, comprising from about 10 to 40 weight % sodium pyrophosphate and from about 8 to 50 weight % sodium carbonate.

5. A granular laundry detergent composition according to claim 4, comprising from about 15 to 35 weight % tetrasodium pyrophosphate and from about 11 to 30 weight % sodium carbonate.

6. A granular laundry detergent composition according to claim 5, wherein said potassium salt has a mean particle size of less than about 200 microns.

7. A granular laundry detergent composition according to claim 1, wherein the potassium salt is selected from the group consisting of potassium chloride, potassium carbonate, potassium sulfate, and mixtures thereof; and has a mean particle size of between about 1 to 10 microns.

8. A granular laundry detergent composition according to claim 7, comprising from about 1 to 3 weight % potassium carbonate.

9. A granular laundry detergent composition according to claim 7, further comprising from about 1 to 10 weight % sodium tripolyphosphate.

10. A granular laundry detergent composition according to claim 7, comprising:

(a) from about 12 to 20 weight % sodium linear $C_{10-16}$ alkylbenzene sulfonate and sodium $C_{12-18}$ alkyl sulfate in a ratio between 50:50 and 80:20;

(b) from about 15 to 35 weight % tetrasodium pyrophosphate;

(c) from about 11 to 30 weight % sodium carbonate;

(d) from about 1 to 5 weight % inorganic potassium salt selected from the group consisting of potassium chloride, potassium carbonate, potassium sulfate, and mixtures thereof, and having a mean particle size of less than about 200 microns.

11. A process for improving solubility or dispersibility of a granular laundry detergent composition according to claim 1, which comprises:

(a) producing detergent granules comprising detergent surfactant selected from the group consisting of anionics, nonionics, zwitterionics, ampholytics, cationics, and mixtures thereof; and sodium phosphate; and (b) admixing with said detergent granules sodium carbonate and potassium salt;

wherein the final detergent composition comprises from about 5 to 70 weight % anionic detergent surfactant, from about 5 to 70 weight % sodium phosphate, from about 5 to 70 weight % sodium carbonate, and from about 1 to 5 weight % potassium salt.

12. A process for improving solubility or dispersibility of a granular laundry detergent composition according to claim 10, which comprises:

(a) forming a paste comprising sodium linear $C_{10-16}$ alkylbenzene sulfonate and sodium $C_{12-18}$ alkyl sulfate in a ratio between 50:50 and 80:20;

(b) crutching the paste with sodium pyrophosphate;

(c) spray drying the mixture of step (b) to form detergent granules; and (d) admixing the detergent granules with sodium carbonate and inorganic potassium salt selected from the group consisting of potassium chloride, potassium carbonate, potassium sulfate, and mixtures thereof, and having a mean particle size of less than about 200 microns;

wherein the final detergent composition comprises from about 12 to 20 weight % sodium linear $C_{10-16}$ alkylbenzene sulfonate and sodium $C_{12-18}$ alkyl sulfate, from about 15 to 35 weight % sodium pyrophosphate, from about 11 to 30 weight % sodium carbonate, and from about 1 to 5 weight % inorganic potassium salt.

13. A process for improving solubility or dispersibility of a granular laundry detergent composition according to claim 12, which further comprises in step (b) crutching said paste with sodium tripolyphosphate so that the final detergent composition comprises from about 1 to 10 weight % sodium tripolyphosphate.

14. A granular laundry detergent composition or additive, comprising:

(a) from about 5 to 70 weight % anionic detergent surfactant;

(b) from about 5 to 70 weight % sodium phosphate;

(c) from about 5 to 70 weight % sodium carbonate; and (d) from 0.1 to 2 weight % potassium salt which has been distributed on the sodium carbonate prior to incorporation into the granular laundry detergent composition.

15. A granular laundry detergent composition according to claim 14, comprising from about 10 to 30 weight % anionic detergent surfactant, from about 10 to 40 weight % sodium pyrophosphate, and from about 8 to 50 weight % sodium carbonate.

16. A process for improving solubility or dispersibility of a granular laundry detergent composition according to claim 14, wherein an aqueous solution of said potassium salt is sprayed onto said sodium carbonate prior to incorporation into said granular laundry detergent composition.

17. A process for improving solubility or dispersibility of a granular laundry detergent composition according to claim 15, wherein an aqueous solution of said potassium salt is distributed on said sodium carbonate prior to incorporation into said granular laundry detergent composition.

* * * * *